US006799869B1

(12) United States Patent
Beadle

(10) Patent No.: US 6,799,869 B1
(45) Date of Patent: Oct. 5, 2004

(54) OUTDOOR LIGHT FIXTURE

(76) Inventor: Joshua Z. Beadle, 5362 Caminito Vista Lujo, San Diego, CA (US) 92130

( * ) Notice: Subject to any disclaimer, the term of this patent is extended or adjusted under 35 U.S.C. 154(b) by 67 days.

(21) Appl. No.: 10/091,103

(22) Filed: Mar. 4, 2002

(51) Int. Cl.[7] ..... F21V 29/00

(52) U.S. Cl. ..... 362/267; 362/350; 362/277; 362/280

(58) Field of Search ..... 362/297, 296, 362/346, 347, 304, 350, 414, 431, 267, 437

(56) References Cited

U.S. PATENT DOCUMENTS

| | | | | | |
|---|---|---|---|---|---|
| 1,430,354 | A | * | 9/1922 | Burdick | 607/90 |
| 1,500,639 | A | * | 7/1924 | Rekar | 362/294 |
| 1,880,399 | A | * | 10/1932 | Benjamin | 362/277 |
| 4,464,707 | A | * | 8/1984 | Forrest | 362/222 |
| 5,025,358 | A | * | 6/1991 | Cannell | 362/267 |
| 5,075,828 | A | | 12/1991 | Gordin et al. | |
| 5,154,628 | A | * | 10/1992 | Skegin | 439/336 |
| 5,226,721 | A | | 7/1993 | Stokes | |
| 5,249,109 | A | | 9/1993 | Denison et al. | |
| 5,303,127 | A | * | 4/1994 | Kosann | 362/296 |
| 5,459,649 | A | | 10/1995 | Ellion | |
| 5,582,479 | A | * | 12/1996 | Thomas et al. | 362/277 |
| 5,718,506 | A | | 2/1998 | Yeh | |
| 5,791,768 | A | * | 8/1998 | Splane, Jr. | 362/280 |
| 6,033,093 | A | * | 3/2000 | Latsis et al. | 362/304 |
| 6,113,433 | A | * | 9/2000 | Al-Turki | 439/639 |
| 6,234,649 | B1 | * | 5/2001 | Katougi | 362/248 |
| 6,357,892 | B1 | | 3/2002 | Beadle | |
| 6,361,193 | B1 | * | 3/2002 | Gabrius et al. | 362/365 |
| 6,422,717 | B1 | | 7/2002 | Beadle | |

FOREIGN PATENT DOCUMENTS

| | | | |
|---|---|---|---|
| DE | 3125373 | A1 * | 2/1983 |
| JP | 401253101 | A * | 10/1989 |

* cited by examiner

*Primary Examiner*—Thomas M. Sember
*Assistant Examiner*—Hargobind S. Sawhney
(74) *Attorney, Agent, or Firm*—Procopio, Cory, Hargreaves & Savitch LLP

(57) ABSTRACT

A light fixture for use in low voltage outdoor lighting systems that comprises a cowl, a lamp, a socket positioned within the cowl for holding the lamp and a collar positioned within the cowl. The collar comprises an inner aperture having a diameter large enough to receive a base of the lamp and a perimeter that the follows the contours of the inner surface of the cowl. The collar seals the socket and the inner portions of the cowl from the elements. Further, the collar is coated for protection from the elements. The light fixture can be attached to a standard sized pipe thread.

25 Claims, 3 Drawing Sheets

OUTDOOR LIGHT FIXTURE

FIELD OF THE INVENTION

The invention relates to a light fixture for use in low voltage outdoor lighting systems and more specifically to a down light fixture which is less susceptible to the effects of oxidation and corrosion.

BACKGROUND OF THE INVENTION

Environmental lighting, particularly outdoor lighting, is well known in commercial or public settings, such as parks and schools. Such lighting is also popular in residential applications, both to enhance the appearance and safety of the outdoor area and for security, to illuminate dark areas around a building or in a yard which may provide hiding places and unobserved entry points for intruders.

Landscape and outdoor lighting systems include one or more lighting fixtures which are connected to either a 12 V transformer or a standard 120 VAC line. Some lighting fixtures enclose a halogen or conventional bulb within a housing, and include a reflector assembly having a lens or window. These fixtures may be used for highlighting features such as trees or statues., i.e., up-lighting, or for path lighting. Other fixtures, used almost exclusively in down-lighting applications, may be open, with the lamp inserted into a socket within a shell or cowl that has its open end directed toward the ground. These fixtures tend to be used in larger quantities within a lighting system since they are typically less expensive than the closed fixtures and are capable of washing large expanses of open area with glare-free light, e.g., pathways, driveways, patios, and for perimeter lighting.

The open fixtures often have a cowl shaped in the form of a bell, half-shell, cone, tulip, or other bell-shaped flower that surrounds the lamp except for the lower end of the cowl from which the light emanates. In addition to preventing escape of light in an upward direction, the inner surface of the cowl acts as a reflector to optimize the amount of light directed toward the desired target area. However, because it is open to the elements, the inner surface of the cowl can become coated with a layer of dust and dirt following repeated exposure to moisture, enhancing corrosion and diminishing the reflectivity of the surface. Further, if the cowl is formed from an uncoated metal such as copper or brass, as commonly used in higher end fixtures, the inner surface of the cowl oxidizes, reducing reflectivity.

One method that has been used to overcome or minimize the effects of build-up and/or oxidation is to treat the inner surface of the cowl by coating it with a white paint or powder coating to produce a porcelain-like white finish, the latter providing a superior finish that is far more durable. However, in most cases, where only the inner surface is to be coated, the rest of the cowl must be masked or otherwise protected to prevent overspray from depositing on the outer surface. Then, after the masking step, the outer surface must be hand buffed to remove any residual markings and to ensure uniformity of the finish, thus introducing additional steps into the manufacturing process that result in the product being more costly.

It would be desirable to provide a light fixture that is attractive, easy to manufacture and provides a reflective surface that is not easily degraded by corrosion or oxidation. The problems and deficiencies are clearly felt in the art and are solved by the present invention in the manner described below.

SUMMARY OF THE INVENTION

It is an advantage of the present invention to provide a light fixture which has a cowl with a high quality reflective inner surface without requiring additional manufacturing steps to protect the exterior finish.

It is a further advantage of the present invention to provide a light fixture with improved resistance to degradation by corrosion and oxidation of the materials of which the fixture is made.

Another advantage of the present invention is to provide a light fixture which protects the lamp base and socket against exposure to the elements and intrusion by foreign objects.

In an exemplary embodiment, the light fixture comprises a spring-blased socket and a lamp retained within a base portion of a cowl disposed at an end of a goose-necked stem through which are passed wires for providing electrical connection between the socket and a power supply. The cowl is generally bell-shaped with a cylindrical base and a flared skirt, but may be any shape having a cavity for retaining the lamp and socket and an open and perhaps partially flared bottom. A collar having a profile closely matching at least a portion of the inner profile of the cowl has an opening at its center through which the base of the lamp passes. The collar, which in the preferred embodiment is formed from aluminum, is coated with a reflective (white) coating and is dimensioned so that light emitted from the lamp is reflected outward away from the fixture. The preferred coating is powder coating. A resilient O-ring is disposed around the base portion of the lamp so that when the lamp base is fastened within the socket, the O-ring presses against the collar, pressing it against the inner surface of the cowl. A metal connector formed preferably from brass can be used to connect the cowl to the stem to reinforce the joint. The stem typically has a threaded fitting at its distal end allowing connection to a riser pipe or ground spike.

The collar provides a reflector which will not degrade even as the material of which the cowl is made oxidizes and, while it is not completely watertight, it provides a barrier to entry of moisture, debris, spiders and insects that often collect within the inner cavities of open ended light fixtures. In an alternate embodiment the outer edges of the collar can have a resilient bead formed from silicone or a similar material so that the bead is compressed between the collar and inner surface of the cowl to enhance the fixture's moisture resistance.

BRIEF DESCRIPTION OF THE DRAWINGS

Understanding of the present invention will be facilitated by consideration of the following detailed description of a preferred embodiment of the present invention taken in conjunction with the accompanying drawings, in which like numerals refer to like parts and in which.

DETAILED DESCRIPTION OF THE INVENTION

Figure 1:
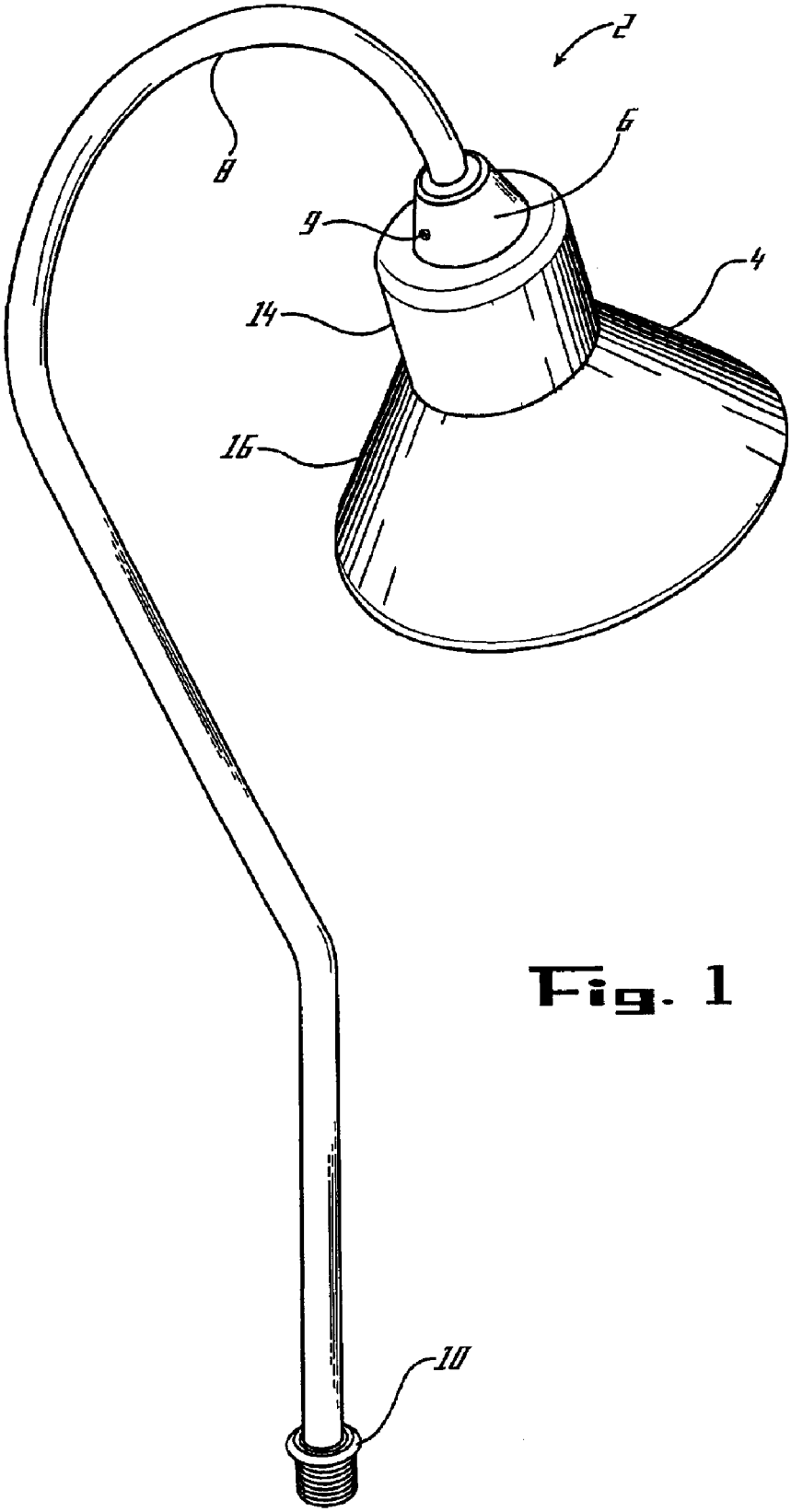
FIG. 1 is a side elevation of the light fixture attached to a spike mount.

As illustrated in FIG. 1, the lighting fixture 2 includes a cowl 4, a head fitting 6, a stem 8 and a base fitting 10 for attachment to ground spike 12. In the preferred embodiment of the invention, cowl 4 is formed from solid copper. The solid copper is intended to oxidize to a verde color and thus is preferably uncoated. Alternate materials may be used, including brass, bronze, stainless steel, coated or anodized aluminum, plastic or polymer. Cowl 4 is generally bell shaped with a crown portion 14 which is generally cylindrical and a skirt portion 16 which flares out from the crown portion 14 and may be formed by machining, die casting, molding, or any other procedure appropriate for the selected materials. Other shapes may be substituted as long as a sufficient recess is provided to enclose the lamp and socket sufficiently to prevent direct viewing of the lamp from above the fixture. For example, tulip or other bell-like flower shapes, pyramids, half-shells, such as a scallop shell, or cones may be used. The shapes are not limited to rounded or symmetrical shapes.

Figure 2:
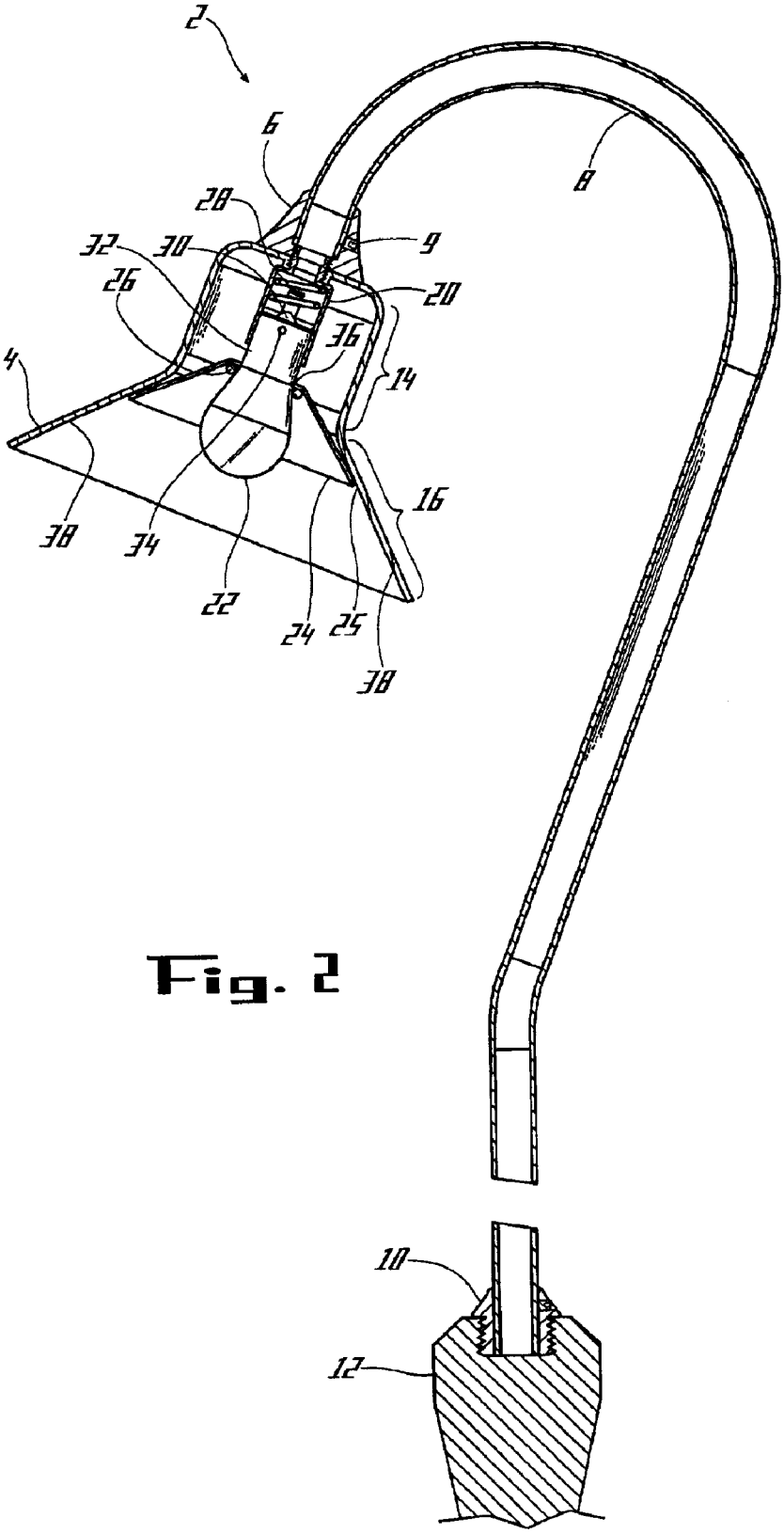
FIG. 2 is a cross-sectional view of the fixture head taken along line A—A. of FIG. 1.

Referring to FIG. 2, head fitting 6 can be cylindrical in shape or a frustum (as shown) and encircles the proximal end of stem 8 to provide a firm connection between cowl 4 and stem 8. A set screw 9 inserted through a threaded bore perpendicular to stem 8 holds the pieces together. Stem 8, shown formed as a goose-neck, and head fitting 6 are hollow to permit wiring to be connected to the lamp socket for connection to a power supply. In the preferred embodiment, head fitting 6 is brass while stem 8 is copper. Base fitting 10, which encircles the distal end of stem 8, has a standard thread pattern, e.g., ½" NPS male thread, at its lower portion for mating with a corresponding opening in ground spike 12. Wires are fed up from the ground spike 12 through base fitting 10 and into stem 8. Alternate mounting means for securing the fixture in place are known to those in the art.

Referring to FIG. 2, retained within cowl 4 are the socket 20, lamp 22, collar 24 and O-ring 26. Socket 20, preferably formed from brass, has a spring 28 disposed within its base which creates an outward bias against the contact 30 that provides electrical connection to lamp 22. Lamp 22 is typically an incandescent bulb which is commercially available in a wide range of wattage ratings. Socket 20 may also be formed from plastic or other appropriate materials. Base 32 of lamp 22 has a conventional bayonet mounting which is commonly used in low voltage lighting fixtures. The bayonet pins 34 mate with corresponding right angle slots in socket 20. The bias created by spring 28 causes lamp 22 to be held firmly in place once the bayonet pins 34 are inserted into the slots and lamp 22 is rotated to trap the pins within the slots. Alternatively, a conventional screw-type connection or an interference fit connection can be used to hold lamp 22 within socket 20.

Figure 3:
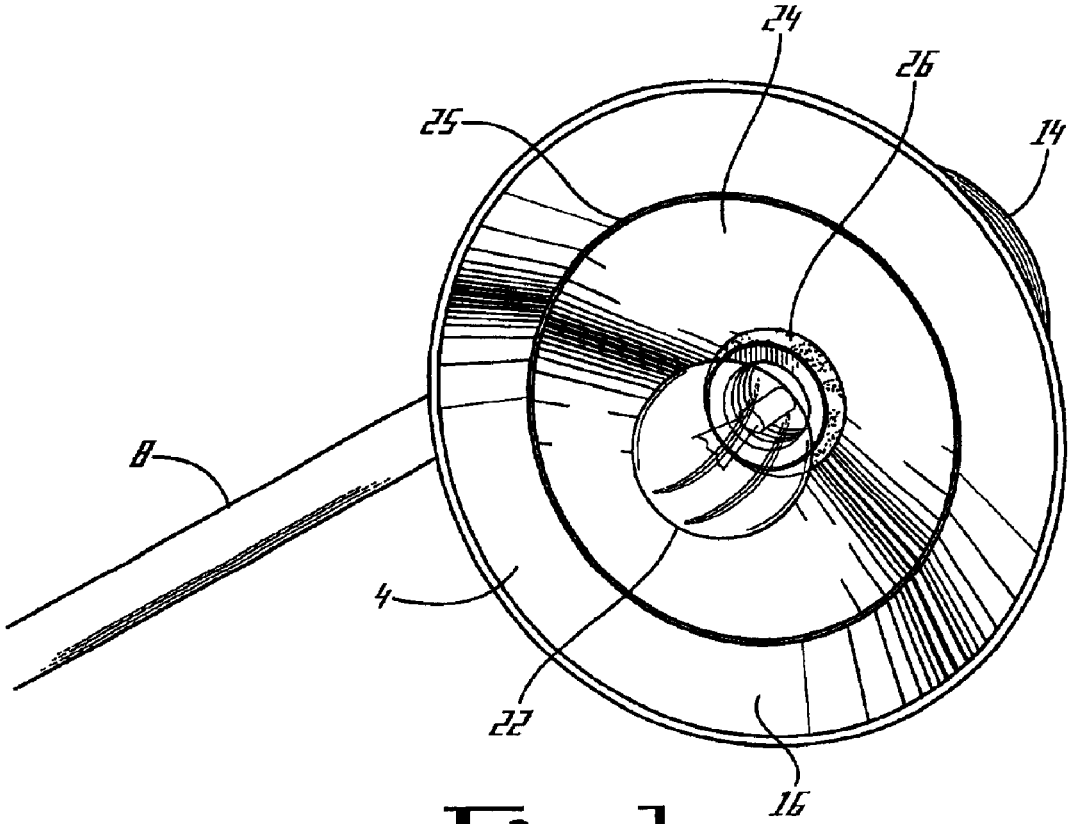
FIG. 3 is a perspective view of the interior of the cowl.

Before lamp 22 is inserted into socket 22, O-ring 26, with an inner diameter that closely fits the outer diameter of lamp base 32, is slid over lamp base 32 up to the uppermost portion of base 32. O-ring 26 is preferably a silicone or other heat tolerant material. Then, collar 24, which has an opening 36 at its center which is larger than the outer diameter of lamp base 32, including the bayonet pins 34, but smaller than the outer diameter of O-ring 26, is slid over the base 32. Collar 24, shown in more detail in FIG. 3, is preferably formed from aluminum or aluminum alloy which has been shaped into a parabolic configuration and powder coated with white, silver or other light color on all surfaces, creating a porcelain-like finish that is very durable and corrosion resistant. In the preferred embodiment, a polyester powder coat is used for its superior durability, corrosion resistance and UV protection, however, other forms of powder coating, or a hard white, silver or other light color enamel paint, may also be used. To provide the highest quality finish on collar 24, it may be treated using a three part process which involves, after shaping the reflector, 1) acid etching the aluminum for optimal adhesion; 2) using chromate conversion to seal the aluminum surface to prevent pitting and blistering; and 3) powder coating. If cowl 4 is not rounded or symmetrical in shape, the shape of collar 24 should be adapted to conform to the profile of the cowl.

When base 32 is inserted into socket 22 and locked in place, the opposing forces of spring 28 and the lamp 22 apply pressure against O-ring 26, pressing collar 24 against the inner surface 38 of cowl 4. In the prior art, the cavity created by crown portion 14 is usually open to the elements. Because this area is open in prior art fixtures, the socket, which in many less expensive products is plastic, will decompose in time, causing the socket to crack and break when the lamps are changed. Further, spiders and insects often make their homes in the protected area of the cowl 4, which can make the act of changing a lamp 22 an unpleasant experience for some persons and can cause the fixture to malfunction.

To further protect socket 22, lamp base 32 and the electrical connections to socket 22, it may be desirable to form a bead of silicone sealant or other resilient material around the upper (inside) edge of collar 24, for instance at 25, to press against the inner surface 38 of cowl 4, to create an even better seal against moisture intrusion. Alternatively, a second O-ring can be placed between the two surfaces to provide the same function. If an O-ring is used, it may be desirable to form a small channel or lip on the upper edge of collar 24 to hold the O-ring in place.

The light fixture of the present invention overcomes several disadvantages of the prior art dealing with corrosion and oxidation of the fixtures which result in decreased light output. Further, the light fixture is easy to manufacture, and is constructed in such a way that the components are readily replaceable without requiring spot welding or permanent fasteners, thus making it more economical all-around relative to existing light fixtures of similar design. Still further, the inventive light fixture is configured so as to reduce the opportunity for moisture, dirt and insect intrusion into the fixture which can interfere with operation and/or shorten the lifetime of the fixture.

Obviously, other embodiments and modifications of the present invention will occur readily to those of ordinary skill in the art in view of these teachings. Therefore, this invention is to be limited only by the following claims which include all such other embodiments and modifications when viewed in conjunction with the above specification and accompanying drawings.

I claim:

1. A light fixture, comprising:

a cowl comprising an open end, a closed end and an inner surface forming a cavity, wherein the inner surface is substantially continuous;

a socket positioned within the cavity and coupled to the inner surface of the closed end of the cowl, the socket being adapted for receiving a base of a lamp;

a collar coupled to the cowl completely within the cavity formed by the cowl, and comprising an internal surface, an external surface, and inner aperture adapted for receiving the base of the lamp and a perimeter that follows contours of the inner surface of the cowl, wherein the collar substantially seals the closed end of the cavity against external elements;

a lamp coupled to the socket, the lamp comprising a light emitting portion, a base and at least one contact; and a stem coupled to the cowl for supporting the cowl so that the open end of the cowl faces generally downward;

wherein the open end of the cowl, the light emitting portion of the lamp and the external surface of the collar are open to external elements.

2. The light fixture of claim 1, wherein at least a portion of the collar is coated with a corrosion-resistant coating.

3. The light fixture of claim 2, wherein the coating is a powder coating.

4. The light fixture of claim 2, wherein the coating is paint.

5. The light fixture of claim 2, wherein the coating is a reflective finish.

6. The light fixture of claim 2, wherein the coating is applied to the inner surface of the collar.

7. The light fixture of claim 1, wherein the cowl comprises a crown portion and a skirt portion, the skirt portion comprising a generally conical cross-section, a first open end and a second open end, whereby a diameter of the second open end is larger than a diameter of the first open end, and the crown portion comprising a generally cylindrical cross-section, an open end and the closed end of the cowl, whereby the open end of the crown portion is coupled to the first open end of the skirt portion.

8. The light fixture of claim 1, wherein the lamp further includes at least one bayonet pin coupled to the base of the lamp.

9. The light fixture of claim 1, further comprising an O-ring closely fitted around the base of the lamp adapted to contact the collar for sealing the inner aperture.

10. The light fixture of claim 1, further comprising a spring adapted to closely fit within the socket, wherein the spring is adapted for forcing the at least one contact in electrical connection with the socket.

11. The light fixture of claim 1, further comprising a head fitting coupled to the cowl for attaching the cowl to the stem.

12. The light fixture of claim 1, wherein the collar is sealed to the inner surface of the cowl.

13. The light fixture of claim 12, wherein the collar is sealed using a silicone sealant.

14. The light fixture of claim 12, wherein the collar is sealed using an O-ring.

15. The light fixture of claim 1, further comprising a ground spike coupled to the stem.

16. The light fixture of claim 1, wherein the stem is coupled to the cowl at the closed end.

17. The light fixture of claim 1, wherein the stem is coupled to the cowl on a side surface of the cowl.

18. A light fixture, comprising:

a cowl comprising a crown portion and a skirt portion, the skirt portion comprising a generally conical cross-section, a first open end and a second open end, whereby a diameter of the second open end is larger than a diameter of the first open end, and the crown portion comprising a generally cylindrical cross-section, an open end and the closed end of the cowl, whereby the open end of the crown portion is coupled to the first open end of the skirt portion, and wherein an inner surface of the cowl is substantially continuous;

a socket positioned within the cavity and coupled to the inner surface of the closed end of the cowl, the socket being capable of receiving a base of a lamp;

a collar coupled to the cowl completely within the cavity formed by the cowl, and comprising an internal surface, an external surface, an inner aperture comprising a diameter at least capable of receiving the base of the lamp and a perimeter that follows contours of the inner surface of the cowl so that the cavity is substantially sealed against external elements, wherein at least a portion of the collar is coated with a reflective coating;

a lamp coupled to the socket, the lamp comprising a light-emitting portion, a base and at least one contact; and a stem coupled to the cowl for supporting the cowl so that the open end of the cowl faces generally downward;

wherein the open end of the cowl, the light emitting portion of the lamp and the external surface of the collar are open to external elements.

19. The light fixture of claim 18, wherein the reflective coating is a powder coating.

20. The light fixture of claim 18, further comprising an O-ring closely fitted around the base of the lamp adapted to contact the collar for sealing the inner aperture.

21. A fixture for projecting light in a downward direction, the fixture comprising:

a mounting stem;

a cowl comprising an upper portion and a flared lower portion, wherein the upper portion is coupled to the stem so that the flared lower portion is directed downward, and wherein an inner surface of the cowl is substantially continuous;

a lamp having a lamp base and a light-emitting portion;

a socket disposed within the upper portion, wherein the socket has an electrical contact disposed therein and is adapted for receiving the lamp; and a collar adapted to closely fit within the upper portion of the cowl so that an inner surface of the upper portion and an upper surface of the collar define a cavity that is substantially sealed against external elements, the collar having an aperture at its center adapted for providing access to the socket for insertion of the lamp;

wherein the flared lower portion of the cowl, the light emitting portion of the lamp and a lower surface of the collar are open to external elements.

22. The fixture of claim 21, wherein at least the lower surface of the collar is coated with a reflective material.

23. The fixture of claim 22, wherein the reflective material is a light-colored powder coating.

24. The fixture of claim 21, further comprising an O-ring closely fitted around the lamp base adapted to contact the collar for sealing the aperture.

25. The fixture of claim 21, further comprising a spring disposed within the socket for providing an outward bias on the electrical contact within the socket.

* * * * *